US008091769B2

(12) United States Patent
Lindsey

(10) Patent No.: US 8,091,769 B2
(45) Date of Patent: Jan. 10, 2012

(54) CARTON AND CARTON BLANK

(75) Inventor: Robert Lindsey, Nailsea (GB)

(73) Assignee: Kraft Foods Global Brands LLC, Northfield, IL (US)

( * ) Notice: Subject to any disclaimer, the term of this patent is extended or adjusted under 35 U.S.C. 154(b) by 790 days.

(21) Appl. No.: 10/578,694

(22) PCT Filed: Nov. 12, 2004

(86) PCT No.: PCT/GB2004/004801

§ 371 (c)(1),
(2), (4) Date: Jun. 1, 2007

(87) PCT Pub. No.: WO2005/049436

PCT Pub. Date: Jun. 2, 2005

(65) Prior Publication Data

US 2007/0272729 A1 Nov. 29, 2007

(30) Foreign Application Priority Data

Nov. 13, 2003 (GB) ..... 0326446.2

(51) Int. Cl.
*B65D 5/00* (2006.01)

(52) U.S. Cl. ..... 229/132; 229/4.5; 229/116.1

(58) Field of Classification Search ..... 229/126, 229/132, 116.1
See application file for complete search history.

(56) References Cited

U.S. PATENT DOCUMENTS 3,094,265 A 6/1963 Hovland
3,934,791 A 1/1976 Dick et al.
4,159,076 A 6/1979 Engdahl
5,911,358 A * 6/1999 Kenner et al. ..... 229/116.1
6,003,759 A * 12/1999 Kenner et al. ..... 229/104
6,019,276 A * 2/2000 Auclair ..... 229/103.2
6,513,704 B1 * 2/2003 Perot ..... 229/104

FOREIGN PATENT DOCUMENTS

DE 7913803 8/1979
DE 3741283 A1 * 6/1989
EP 0814025 A1 12/1997
EP 0814025 B1 4/2002
FR 1031851 6/1953

* cited by examiner

*Primary Examiner* — Nathan J Newhouse
*Assistant Examiner* — Christopher Demeree
(74) *Attorney, Agent, or Firm* — Hoffmann & Baron, LLP

(57) ABSTRACT

A carton blank (10) for a carton is formed from a sheet material and has a plurality of foldably connected panels which form the walls of the corresponding carton. The panels include main panels (11-14) separated by a plurality of longitudinal folds (16-19) and arranged to form pairs of opposing side walls in said corresponding carton. A first pair of main panels (11, 13) are each foldably connected at either end to a respective end panel (22, 23, 26, 27), said end panels being arranged to form opposing end walls in said corresponding carton with each end wall including first and second end panels. A second pair of main panels (12, 14) are each foldably connected at either end to a transverse edge of a respective end flap (36-39). The blank is foldable to provide a corresponding carton in which the transverse edges of the opposing side walls formed by said second pair of main panels are arranged in general correspondence with the longitudinal edges of adjacent respective end panels and the transverse edges of the respective end flaps connected thereto. At least one of said first end panels (26, 27) is provided with an end tab (31, 32) foldably connected thereto and adapted for fixation to a side wall 11 or to an underside of the corresponding second end panel (22, 23) in said corresponding carton.

51 Claims, 2 Drawing Sheets

CARTON AND CARTON BLANK

CROSS-REFERENCE TO RELATED APPLICATIONS

This application is the National Stage of International Application No. PCT/GB2004/004801, filed Nov. 12, 2004, which claims the benefit of United Kingdom Application No. GB 0326446.2, filed Nov. 13, 2003, the contents of which are incorporated by reference herein.

FIELD OF THE INVENTION

The present invention relates to a carton, more particularly to a carton for storing food and the like, and to a carton blank therefor.

BACKGROUND OF THE INVENTION

Cartons made from cardboard or similar materials are widely used for storing food and the like. The cartons are typically formed by assembly of corresponding carton blanks through a series of folds to provide the required carton shape defining an interior void for the containment of the item or items to be stored.

A problem, however, is to ensure that the assembled carton retains its form to provide a useful store. For example, if the carton is not effectively fixed in its assembled form, then one or more component sections of the carton, such as flaps, panels, tabs, etc., may intrude into the interior void, thereby significantly reducing the storage capacity of the carton, and weakening the structural integrity thereof. This problem has been addressed, for example in WO 98/01351 which describes a package assembled from a blank of cardboard or similar material and having end walls formed by flaps and intermediate flaps folded and glued to one another to maintain the form of the assembled package. The end walls are assembled using at least four folding steps, i.e. at least four end wall components are sequentially folded. EP 0814025 describes a box assembled from a blank in which the end walls of the box are formed by main end surfaces and a number of auxiliary end surfaces that are folded and mutually glued. Again, the end walls are assembled using at least four folding steps.

The present invention provides an alternative solution to the aforementioned problem.

SUMMARY OF THE INVENTION

According to a first aspect of the present invention, therefore, there is provided a carton blank for a carton formed from a sheet material, comprising a plurality of foldably connected panels which form the walls of the corresponding carton, said panels comprising main panels separated by a plurality of longitudinal folds and arranged to form pairs of opposing side walls in said corresponding carton, a first pair of main panels each being foldably connected at either end to a respective end panel, said end panels being arranged to form opposing end walls in said corresponding carton, each end wall comprising first and second end panels, and a second pair of main panels each being foldably connected at either end to a transverse edge of a respective end flap, wherein said blank is foldable to provide said corresponding carton in which the transverse edges of the opposing side walls formed by said second pair of main panels are arranged in general correspondence with the longitudinal edges of adjacent respective end panels and the transverse edges of the respective end flaps connected thereto, and wherein at least one of said first end panels is provided with an end tab foldably connected thereto and adapted for fixation to a side wall or to an underside of the corresponding second end panel in said corresponding carton.

Thus, the present invention provides a carton blank foldable to provide a corresponding carton which may be securely assembled. The end tab is fixed to a side wall or to an underside of the corresponding second end panel, i.e. the surface of said second end panel facing inwards in the assembled carton, to maintain the form of the respective end wall, preventing ingress of end wall components into the interior void. Advantageously, each end wall may be formed from the corresponding end panels and end flaps using only three folding steps.

A particularly preferred embodiment of the present invention provides a carton blank for a carton having four side walls.

The at least one first end panel provided with an end tab is preferably provided with an end tab foldably connected via a transverse fold to an end of said at least one first end panel opposite the end thereof foldably connected to the respective main panel. In the particularly preferred embodiment of the present invention providing a carton blank for a corresponding carton having four side walls, therefore, the end tab may be fixable to the side wall opposite the side wall formed by the main panel to which said end tab is indirectly connected via the intervening respective first end panel. In the assembled corresponding carton, the end tab may be folded through approximately 90° for fixation to the side wall. Alternatively, the end tab may be fixable to the underside of the corresponding second end panel foldably attached to the side wall opposite the side wall formed by the main panel to which said end tab is indirectly connected via the intervening respective first end panel. The end tab is preferably fixable to the underside of said second end panel such that the transverse fold connecting said end panel is substantially aligned with a transverse fold connecting said corresponding second end panel to the respective main panel. In the corresponding carton, the end tab may be folded through approximately 180° once the second end panel is secured in position.

The end tab may be adapted for fixation in any suitable manner, for example by adhesion using a suitable adhesive agent.

The end tab may take any suitable form. In certain embodiments, the end tab may be sized and shaped to provide optimal interaction between the various end wall components in the corresponding carton. For example, the end tab may be sized and shaped for fixation to a portion of the underside of the corresponding second end panel that does not contact an adjacent end flap in the assembled carton. Conversely, the adjacent end wall components may be sized and shaped to contact one another at points not covered by the fixed end tab.

With regard to the sheet material, this may comprise any suitable material. Typically, the sheet material will comprise cardboard or other foldable material such as plastics. Advantageously, the carton blank may be formed from a single piece of sheet material.

The main panels may take any suitable form. For example, the main panels may comprise generally rectangular panels, the longitudinal folds separating the main panels thus being substantially parallel to one another.

Typically, at least a first main panel is provided with a side tab foldably connected to a longitudinal edge thereof, said tab being adapted for fixation to a further main panel the longitudinal edge of which is adjacent the longitudinal edge of said first main panel in the corresponding assembled carton. Said side tab may conveniently be of substantially the same length as said first main panel, whereby said first main panel may be securely fixed to said further main panel along substantially its entire length. The side tab may be fixable in any suitable manner, preferably using an appropriate adhesive.

The first pair of main panels may have substantially the same or different width in the transverse direction from the second pair of main panels. Typically, the main panels will be of substantially equal length in the longitudinal direction, thereby providing a carton blank for a corresponding carton having end walls generally at right angles to the side walls thereof, the end panels each being folded through approximately 90° about a respective transverse fold to form said end walls. However, it will be appreciated that other configurations are possible.

Similarly, the main panels within each of said first and second pairs of main panels may be of substantially equal dimensions such that the carton blank may be assembled into a corresponding carton in which opposing walls of substantially the same length and width provide a carton with substantial symmetry. Again, however, it will be appreciated that a variety of alternative configurations may be employed.

The end panels are foldably connected at the transverse end of the respective main panels, preferably being sized and shaped to form end walls in the corresponding carton which provide, in conjunction with the adjacent side walls, substantially continuous enclosure of the interior void defined within said carton. Thus, in the particularly preferred embodiment of a present invention providing a carton blank for a carton having four side walls, the end panels preferably have a length in the longitudinal direction substantially the same as the distance in the transverse direction between the opposing side walls of the corresponding carton formed by the first pair of main panels, such that the end walls span the distance between the opposing side walls formed by the first pair of main panels. Similarly, the width in the transverse direction of the end panel corresponds substantially to the distance between the opposing side walls formed by the second pair of main panels.

With regard to the end flaps, these may take any suitable form. The transverse edge of each end flap may comprise a transverse fold, wherein the end flap is continuous with the respective main panel and separated therefrom by said transverse fold. Alternatively, the end flaps may be connected to the respective main panel via a connecting portion, which may be equidistant from either end of the transverse edge of said respective main panel. In certain embodiments, each end flap as a whole may be symmetrical about a central longitudinal line of symmetry, although, equally, in other embodiments the end flaps may not display such symmetry.

As mentioned above, the end wall components may be sized and shaped for optimal interaction therebetween. Thus, the end flaps may be configured to contact parts of the adjacent end panels not covered by the fixed end tab. Similarly, the end flaps and/or end panels may be provided with one or more cutaway portions that permit contact between end wall components positioned on either side thereof in the assembled carton. Advantageously, therefore, the first and second end panels may simultaneously contact each other and each of the adjacent end flaps in the corresponding assembled carton.

The corresponding end panels and end flaps are preferably fixed together in the corresponding carton to provide secure opposing end walls. Said end panels and end flaps may be mutually fixable in any suitable manner, such as using an appropriate adhesive.

The present invention may provide a carton blank foldable into a carton in which the opposing side walls formed by the second pair of main panels are curved. Preferably, the opposing side walls formed by said second pair of main panels are curved outwards, i.e. in a convex manner, in the assembled carton.

This may be achieved, for example, by the provision of a carton blank in which the transverse edge of each end flap foldably connected to the respective main panels is curved and the end panels have corresponding curved opposing longitudinal edges. Thus, in the assembled carton, transverse edges of the opposing side walls formed by the second pair of main panels are arranged in general correspondence with the curved longitudinal edges of adjacent respective end panels and the curved transverse edges of the respective end flaps, whereby said opposing side walls formed by the second pair of main panels have a curved profile in the transverse direction. The curved longitudinal edges of said end panels describe, at least in part, generally the same curvilinear path as the corresponding edges of the curved side walls of the assembled carton formed by the second pair of main panels, i.e. the curvilinear path described by the curved transverse edge of the respective end flap foldably connected to each of said second pair of main panels.

In this particular embodiment, the curved transverse edge of the end flap is preferably foldably connected to the respective main panel via a connecting portion, most preferably via a connecting portion approximately equidistant from either end of said curved edge. Preferably also, therefore, said connecting portion foldably connects said end flap to said respective main panel at a point approximately equidistant from either end of the transverse edge of said respective main panel. The curved edge of the end flaps may, therefore, be substantially symmetrical about a central longitudinal line of symmetry. This arrangement provides a carton having opposing side walls formed by the second pair of main panels which are symmetrically curved about a longitudinal line of symmetry.

According to a second aspect of the present invention, there is provided a carton formed from a carton blank as hereinbefore described.

The assembled carton may be held together using a suitable adhesive, applied to the appropriate tabs and/or panels of the corresponding carton blank.

The carton may, if desired, be provided with means to facilitate the initial opening thereof. For example, a tearable band or strip of the kind known in the art may be provided which, when pulled, produces a tear in the side walls of the carton, preferably a continuous, generally transverse tear in at least three of the side walls, thereby allowing easy access to the stored contents. The corresponding carton blank may therefore be provided with a pre-cut band defined by cuts or perforations cut in the sheet material. The pre-cut band preferably spans the carton blank in the transverse direction. A grip tab may be provided to facilitate a user in pulling the tearable band. A carton blank formed from a fibrous sheet material, such as cardboard, may be provided with a pre-cut band possibly and running in generally the direction of the constituent fibres to permit a clean tear along the pre-cut edges of the tearable band.

According to a third aspect of the present invention there is provided a method of forming a carton from a corresponding carton blank as hereinbefore described, the method comprising the step of fixing the end tab foldably connected to at least one of the first end panels to a side wall or to the underside of the corresponding second end panel.

The end tab may be fixed to the side wall or corresponding second end panel using a suitable adhesive, which may be applied or pre-applied to the surface of the end tab to be fixed to a side wall or corresponding second end panel in the formation of the carton.

In a preferred embodiment of the present invention, the method of forming the carton is initiated by folding the main panels along their respective longitudinal folds to form the side walls of the carton. The side walls may be held in the desired arrangement by means of a side tab foldably connected to a longitudinal edge of a first main panel. Thus, the method may include the step of fixing a first main panel to a further main panel brought adjacent thereto in the folded arrangement by fixing a side tab foldably connected to said first main panel to said further main panel. The side tab may be fixed, for example, using an adhesive, which may if desired be pre-applied to said side tab.

Having formed the side walls of the carton, the next step of the method is to form the first of the two end walls. This is achieved by folding and fixing the respective end panels and end flaps. The first end panel having the end tab connected thereto is first folded and held in position by fixation, possibly adhesion, of said first end tab to a side wall or to the underside of the corresponding second end panel, the end tab having itself been folded into the appropriate configuration. Typically, the end tab will be fixed to the side wall opposite the side wall to which it is indirectly connected via the intervening first end panel, or to the underside of the second end panel that is foldably connected to said side wall opposite the side wall to which it is indirectly connected via the intervening first end panel.

The folding and fixation of the first end panel, by means of the end tab foldably connected thereto, provides a secure base for the remainder of the end wall components to be folded and fixed together to form the end wall. These remaining components, i.e. a further end panel and two opposing end flaps, may be folded in different sequences. Advantageously, the end wall may be formed in three sequential folding steps.

One embodiment of the method according to this aspect of the present invention sees the first end panel folded and fixed in position as described above. The opposing end flaps connected to respective opposing side walls formed by the second pair of main panels are then folded into position. The end flaps are preferably folded substantially simultaneously, such that this movement comprises a single folding step. The end flaps may be fixed in position, for example, using an adhesive. An adhesive may be applied or pre-applied to a surface of the end flaps and/or to a surface of the first end panel with which the folded end flaps make contact. Once the end flaps have been folded into position, the end wall formation is completed by the folding of the corresponding second end panel, which is fixed in position, for example using an adhesive. An adhesive may be applied or pre-applied to a surface of said second end panel and/or to a surface of one or more of the end flaps or the first end panel with which the folded second end panel makes contact.

In an alternative embodiment of the method according to this aspect of the present invention, following the folding and fixation of the first end panel, the remaining end panel is folded into position and preferably fixed, for example, by means of an adhesive which may be applied or pre-applied to a surface of the corresponding second end panel and/or to the surface of the first end panel with which said second end panel makes contact in the folded configuration. The opposing end flaps are then folded into position, preferably by simultaneous folding thereof, and fixed in place. The end flaps may be fixed, for example, using an adhesive which may be applied or pre-applied to a surface of the end flaps and/or to the surface of the end panel(s) with which the folded end flaps make contact.

The first end wall having been formed, the next step of the method according to this aspect of the present invention is the insertion of the item or items to be stored into the interior void defined by the assembled side walls and first end wall of the carton. The item or items to be stored may be inserted in any conventional manner. Optionally, the item or items may be enclosed within a bag.

After insertion of the item or items to be stored, the second end wall is formed, most preferably in substantially the same manner as the first. The result is an assembled carton containing the item or items to be stored therein.

As an alternative, an item or items, optionally enclosed within a bag, may be inserted into the partially assembled carton prior to formation of the first end wall, the first and second end walls then being formed as described above.

BRIEF DESCRIPTION OF THE DRAWINGS

The present invention will now be described further by way of example only with reference to the accompanying drawings, in which.

DETAILED DESCRIPTION OF PREFERRED EMBODIMENTS

Figure 1:
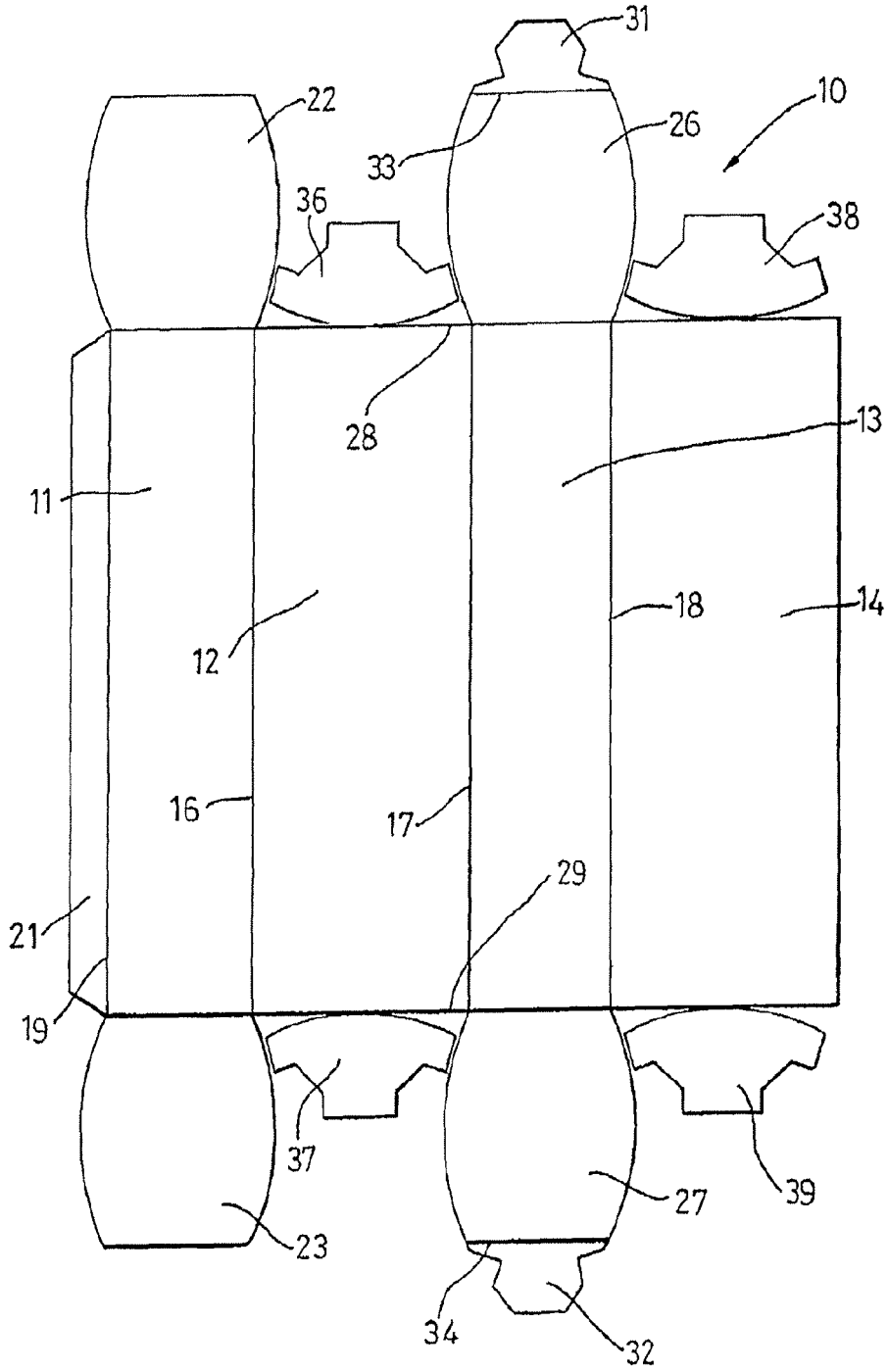
FIG. 1 is a plan view of a first embodiment of a carton blank according to one aspect of the present invention.
Figure 2:
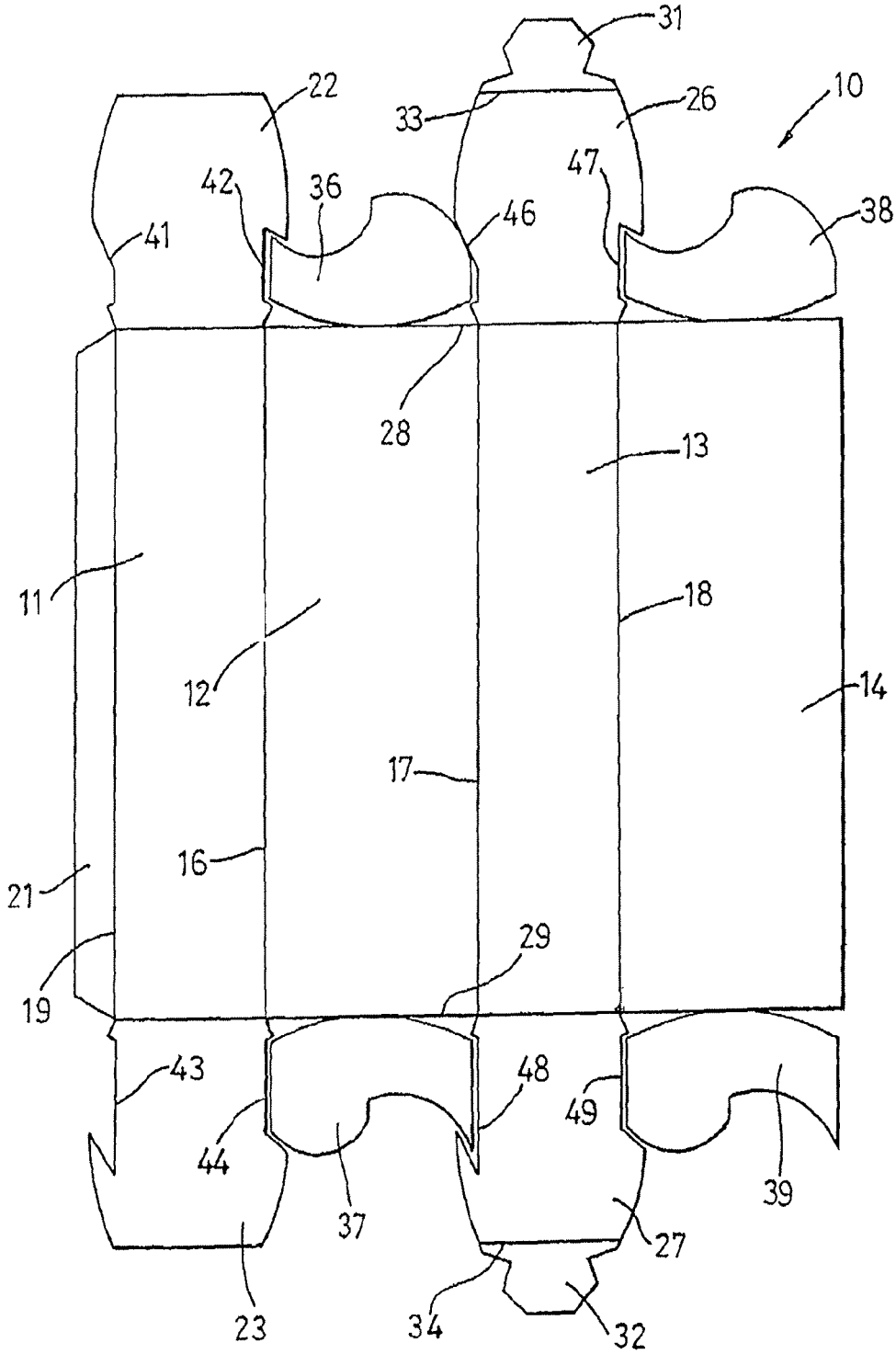
FIG. 2 is a plan view of an alternative embodiment of a carton blank according to one aspect of the present invention.

Referring to FIGS. 1 and 2, a carton blank 10 for a corresponding carton is pre-cut from a single piece of flat sheet material, such as, for example, cardboard. The carton blank 10 comprises four main panels 11, 12, 13, 14 bordered by substantially parallel longitudinal folds 16, 17, 18, 19. The main panels 11, 12, 13, 14 are substantially regular and rectangular in shape, and are arranged to form pairs of opposing side walls in the corresponding carton. A side tab 21 is foldably connected to a main panel 11 via a longitudinal fold 19. The side tab 21 is practically the same length as the main panel 11.

The carton blank 10 further comprises four end panels 22, 23, 26, 27 foldably connected to main panels 11, 13, wherein two first end panels 26 and 27 are connected at either end of a respective main panel 13 and two second end panels 22 and 23 are connected at either end of a further respective main panel 11. The end panels 22 and 26 are connected to the main panels 11, 13 via a transverse fold 28, whereas the end panels 23 and 27 are connected to the opposite end of the main panels 11, 13 via a further transverse fold 29.

The four panels 22, 23, 26, 27 are substantially the same shape, each having at least partially outwardly curved longitudinal edges and being substantially symmetrical about a central longitudinal line of symmetry. The transverse folds 28, 29 run generally at right angles to the longitudinal folds 16, 17, 18, 19.

The first end panels 26 and 27 are each provided with an end tab, 31 and 32 respectively, foldably connected thereto. The end tabs 31, 32 are adapted for fixation to the underside of the corresponding second end panel (22, 23 respectively) in the corresponding assembled carton and are connected to the respective first end panels 26, 27 via respective transverse folds 33, 34.

The carton blank 10 also has end flaps 36, 37, 38, 39 foldably connected to main panels 12, 14, wherein two end flaps 36 and 37 are connected at either end of a respective main panel 12 and two end flaps 38, 39 are connected at either end of a further respective main panel 14. The end flaps 36, 37, 38, 39 are substantially the same shape, being connected to the respective main panels 12, 14 via the respective transverse folds 28, 29. The end flaps 36, 37, 38, 39 each have curved transverse edges, a generally central part of which connects each of said end flaps 36, 37, 38, 39 to the respective main panels 12, 14 via said respective transverse folds 28, 29. The curved transverse edges of the end flaps 36, 37, 38, 39 describe generally the same curvilinear path as the at least partially curved longitudinal edges of the end panels 22, 23, 26, 27.

To assemble the corresponding carton from the carton blank 10, the carton blank is folded about the longitudinal folds 16, 17, 18, 19 to provide a first pair of opposing side walls formed from main panels 11 and 13 and a second pair of opposing side walls formed from main panels 12 and 14. This configuration is maintained by fixation of the side tab 21 to the newly adjacent main panel 14. Fixation may be achieved using a suitable adhesive applied or pre-applied to contacting surfaces of either or both of the side tab 21 and main panel 14.

Next, a first end panel 26 having a first end tab 31 connected thereto is folded through substantially 90°. The end tab 31 is also folded through substantially 90° and fixed to the newly adjacent underside of the corresponding second end panel 22 foldably connected to the main panel 11 opposing the main panel 13 to which the end tab 31 is indirectly connected via the intervening first end panel 26. Thus, the transverse fold connecting the end tab 31 to the first end panel 26 is brought into substantial alignment with the transverse fold 28 at the point where the second end panel 22 is foldably connected to the adjacent main panel 11. The end tab 31 may be fixed, possibly by adhesion, to the second end panel by means of a suitable adhesive. The transverse edges of the second pair of opposing side walls formed by main panels 12 and 14 are arranged in general correspondence with the curved longitudinal edges, or curved parts of said longitudinal edges, of the now adjacent first end panel 26, said opposing side walls 12, 14 thus being outwardly curved.

Referring now to FIG. 1, the opposing end flaps 36 and 38 are now folded through approximately 90° about the transverse fold 28, such that the curved transverse edges of said end flaps 36, 38 are brought into general correspondence with the curved transverse edges of the respective adjoining main panels 12, 14 and the curved longitudinal edges of the now adjacent first end panel 26. The end flaps 36, 38 are preferably folded simultaneously. The end flaps may be fixed in position, for example, using a suitable adhesive. The end flaps 36, 38 are adapted such that in this folded arrangement they collectively cover only a portion of the adjacent surface of the first end panel 26. More particularly, the folded end flaps 36, 38 do not cover a portion of the adjacent surface of the first end panel 26 adjacent the end tabs 31 foldably connected thereto, nor do they cover a portion of the first end panel adjacent the transverse fold 28.

Thus, when the first end wall is completed by the folding of the corresponding second end panel 22, again through approximately 90°, the surface of the end tab 31 not fixed to the underside of the second end panel 22 makes contact with the outermost surface of the first end panel 26 to which said end tab 31 is foldably connected. The end tab 31 is therefore subjected to two folds of approximately 90°, to take up a final position in the assembled carton approximately 180° from its starting position. In the assembled configuration, the underside of the second end panel 22 makes contact with the outermost surface of the first end panel 26 via the portion of said first end panel 26 situated adjacent the transverse fold 28 and not covered by the respective folded end flaps 36, 38. The various end wall components 22, 26, 31, 36, 38 are therefore mutually fixable using, for example, a suitable adhesive.

The second end wall may be formed in the same manner.

Referring now to the alternative embodiment of one aspect of the present invention shown in FIG. 2, the first end panel 26 having first been folded and fixed to the underside of the corresponding second end panel 22 by means of the end tab 31, as described in relation to the embodiment of this aspect of the present invention as depicted in FIG. 1, the corresponding second end panel 22 is folded through approximately 90° about the respective transverse fold 28, thereby bringing it into contact with the first end panel 26, where it may be fixed using, for example, an adhesive agent. The curved longitudinal edges of the end panels 26, 22 are arranged to provide curved end wall edges. The end panels 22, 23, 26, 27 have peripheral cutaway portions 41, 42, 43, 44, 46, 47, 48, 49, which accommodate the edges of adjacent end flaps 36, 37, 38, 39 in the unfolded carton blank.

The first end wall is then completed by the folding of the adjacent end flaps 36, 38 through approximately 90° about the transverse fold 28, said end flaps 36, 38 preferably being folded substantially simultaneously. The end flaps 36, 38 are then fixed in position, for example using an adhesive. The underside of each of the end flaps 36, 38 makes contact with both the outermost surface of the adjacent second end panel 22 and also with the portion of the outermost surface of the exposed through the cutaway portions 41, 42 of said adjacent second end panel 22.

The second end wall may be completed in the same manner.

Thus, the present invention provides a carton blank 10, a corresponding carton and a method of forming said corresponding carton from said carton blank 10. An item or items to be stored may be inserted into the interior void defined by the partially assembled carton following formation of the side walls and first end wall, after which the second end wall may be formed and secured. Alternatively, said item or items may be inserted after formation of the side walls and prior to formation of the first end wall, both the first and second walls then being formed to enclose the item or items.

The carton may be opened by disassembly of an end wall. Clearly, any adhesive used in the mutual fixation of the end wall components will be selected with this in mind.

It is of course to be understood that the present invention is not intended to be restricted to the details of these specific embodiments, which are described by way of example only.

What is claimed is:

1. A carton blank for a carton, said carton blank being formed from a sheet material and comprising a plurality of foldably connected panels which form the walls of the corresponding carton, said panels comprising main panels separated by a plurality of longitudinal folds and arranged to form pairs of opposing side walls in said corresponding carton a first pair of main panels each being foldably connected at either end to a respective end panel, said end panels being arranged to form opposing end walls in said corresponding carton, each end wall comprising first and second end panels, and a second pair of main panels each being foldably connected at either end to a respective end flap, each of said respective end flap includes a curved traverse edge, said curved traverse edge includes a central attached portion and an unattached portion on either side of said central attached portion, said second pair of main panels being foldably connected to said respective end flap at said central attached portion and said unattached portions remain unattached from said respective end flaps, wherein said blank is foldable to provide said corresponding carton in which the transverse edges of the opposing side walls formed by said second pair of main panels are arranged in general correspondence with the longitudinal edges of adjacent respective end panels and the transverse edges of the respective end flaps connected thereto, and wherein one of said first main panels includes an end tab foldably connected to each of said first end panel and adapted for fixation to a side wall or to an underside of the corresponding second end panel in said corresponding carton.

2. A carton blank as claimed in claim 1, in which the blank is arranged to form a carton having four side walls.

3. A carton blank as claimed in claim 1, in which the end tab is adapted to be folded for fixation to a side wall.

4. A carton blank as claimed in claim 1, the arrangement being such that the end tab is fixable to the underside of the corresponding second end panel foldably attached to the side wall opposite the side wall formed by the main panel to which said end tab is indirectly connected via the intervening respective first end panel.

5. A carton blank as claimed in claim 4, the arrangement being such that the end tab is fixable to the underside of said second end panel so that the transverse fold connecting said first end panel to the respective main panel is substantially aligned with a transverse fold connecting said corresponding second end panel to the respective main panel.

6. A carton blank as claimed in claim 4, the arrangement being such that, in the corresponding carton, the end tab is folded through approximately 180° once the second end panel is secured in position.

7. A carton blank as claimed in claim 6, in which the end tab is adapted for fixation by adhesion using a suitable adhesive agent.

8. A carton blank as claimed in claim 7, in which the end tab is sized and shaped to provide optimal interaction between the various end wall components in the corresponding carton.

9. A carton blank as claimed in claim 8, in which the end tab is sized and shaped for fixation to a portion of the underside of the corresponding second end panel that does not contact an adjacent end flap in the assembled carton.

10. A carton blank as claimed in claim 8, in which the adjacent end wall components are sized and shaped to contact one another at points not covered by the fixed end tab.

11. A carton blank as claimed in claim 10, in which the sheet material comprises cardboard.

12. A carton blank as claimed in claim 1, in which the sheet material comprises a plastics material.

13. A carton blank as claimed in claim 12, formed from a single piece of sheet material.

14. A carton blank as claimed in claim 13, in which the main panels comprise generally rectangular panels, the longitudinal folds separating the main panels being substantially parallel to one another.

15. A carton blank as claimed in claim 14, in which at least a first main panel is provided with a side tab foldably connected to a longitudinal edge thereof, said tab being adapted for fixation to a further main panel the longitudinal edge of which is adjacent the longitudinal edge of said first main panel in the corresponding assembled carton.

16. A carton blank as claimed in claim 15, in which the side tab is substantially the same length as said first main panel.

17. A carton blank as claimed in claim 15, in which the side tab is fixable using an adhesive.

18. A carton blank as claimed in claim 17, in which the first pair of main panels have substantially the same width in the transverse direction from the second pair of main panels.

19. A carton blank as claimed in claim 18, in which the main panels are of substantially equal length in the longitudinal direction.

20. A carton blank as claimed in claim 19, in which the main panels within each of said first and second pairs of main panels are of substantially equal dimensions such that the carton blank may be assembled into a corresponding carton in which opposing walls of substantially the same length and width provide a carton with substantial symmetry.

21. A carton blank as claimed in claim 20, in which the end panels are foldably connected at the transverse end of the respective main panels, and are sized and shaped to form end walls in the corresponding carton which provide, in conjunction with the adjacent side walls, a substantially continuous enclosure of the interior void defined within the corresponding assembled carton.

22. A carton blank as claimed in claim 21, in which said central attached portion of each end flap comprises a transverse fold, wherein the end flap is continuous with the respective main panel and separated therefrom by said transverse fold.

23. A carton blank as claimed in claim 1, in which each end flap is connected to its respective main panel via a connecting portion of said central attached portion, which is equidistant from either end of the transverse edge of said respective main panel.

24. A carton blank as claimed in claim 23, in which the end flaps and/or end panels are provided with one or more cutaway portions that permit contact between end wall components positioned on either side thereof in the assembled carton.

25. A carton blank as claimed in claim 24, in which corresponding end panels and end flaps are adapted to be fixed together in the corresponding carton to provide secure opposing end walls.

26. A carton blank as claimed in claim 25, in which said end panels and end flaps are mutually fixable using an appropriate adhesive.

27. A carton blank as claimed in claim 26, in which the blank is foldable into a carton in which the opposing side walls formed by the second pair of main panels are curved.

28. A carton blank as claimed in claim 27, in which the opposing side walls formed by said second pair of main panels are curved outwards, i.e., in a convex manner, in the assembled carton.

29. A carton blank as claimed in claim 28, in which the transverse edge of each end flap foldably connected to the respective main panels is curved and the end panels have corresponding curved opposing longitudinal edges.

30. A carton blank as claimed in claim 29, in which the blank is arranged such that, in the assembled carton, transverse edges of the opposing side walls formed by the second pair of main panels are arranged in general correspondence with the curved longitudinal edges of adjacent respective end panels and the curved transverse edges of the respective end flaps, whereby said opposing side walls formed by the second pair of main panels have a curved profile in the transverse direction.

31. A carton blank as claimed in claim 28, in which the central attached portion of the curved transverse edge of each end flap is foldably connected to the respective main panel via a connecting portion that is approximately equidistant from either end of said curved edge.

32. A carton blank as claimed in claim 31, in which said connecting portion foldably connects said end flap to said respective main panel at a point approximately equidistant from either end of the transverse edge of said respective main panel.

33. A method of forming a carton from a corresponding carton blank comprising the following sequential steps:

a) cutting a piece of flat sheet material into a corresponding carton blank, said corresponding carton blank comprises main panels boarded by parallel longitudinal folds defining first main panel foldably connected to second main panel foldably connected to third main panel foldably connected to fourth main panel, a pair of second end panels foldably connected to either end of said first main panel, a pair of first end panels foldably connected to either end of said third main panel, two pairs of end flaps each having a curved transverse edge defining first pair of end flaps and second pair of end flaps, said curved traverse edge including a central attached portion and unattached portions on either side of said central attached portion, said first pair of end flaps are foldably connected to only said central portion of said curved transverse edge to either end of said second main panel, and said second pair of end flaps are foldably connected to said central portion of said curved transverse edge to either end of said fourth main panel;

b) folding the main panels along their respective said longitudinal folds to form side walls of the carton; and c) folding said pair of first end panels, said pair of second end panels, and said two pairs of end flaps to form end walls.

34. A method of forming a carton from a corresponding carton blank as claimed in claim 33, the method comprising further including the step of fixing an end tab foldably connected to at least one of the first pair of end panels to one of said side wall or to the underside of the corresponding second end panel.

35. A method as claimed in claim 34, wherein the end tab is fixed to the side wall or corresponding second end panel using a suitable adhesive.

36. A method as claimed in claim 35, wherein the adhesive is pre-applied to the surface of the end tab to be fixed to a side wall or corresponding second end panel in the formation of the carton.

37. A method as claimed in claim 34, in which the end tab, and/or the side tab, and or the end panels and/or the end flaps are secured in position by means of an adhesive.

38. A method as claimed in claim 37, in which the adhesive is pre-applied.

39. A method as claimed in claim 34, in which the end tab is secured to said side wall.

40. A method as claimed in claim 34, in which the end tab is secured to the underside of the second end panel.

41. A method as claimed in claim 33, wherein the side walls held in the desired arrangement prior to the step of forming the end walls.

42. A method as claimed in claim 41, in which the side walls held in the desired arrangement by means of a side tab foldably connected to a longitudinal edge of a first main panel.

43. A method as claimed in claim 42, wherein the method includes the step of fixing a first main panel to said fourth main panel brought adjacent thereto in the folded arrangement by fixing said side tab foldably connected to said first main panel to said fourth main panel.

44. A method as claimed in claim 33, in which each end wall is formed by folding and fixing the respective end panels and end flaps.

45. A method as claimed in claim 44, in which the process of forming each end wall comprises the following sequential steps:

a) folding one of the pair of first end panel having an end tab connected thereto and holding the one of the pair of first end panel in position by fixing the end tab to one of said side walls or to the underside of the corresponding one of said pair of second end panel, the end tab having itself been folded into the appropriate configuration;

b) folding one of said first pair of end flaps and one of said second pair of end flaps defining opposing end flaps into position; and c) folding the one of said pair of second end panel and securing in position.

46. A method as claimed in claim 45, in which the end flaps are secured in position using an adhesive prior to the step of folding the one of said pair of second end panel.

47. A method as claimed in claim 44, in which the process of forming each end wall comprises the following sequential steps:

a) folding the first end panel having the end tab connected thereto and holding the first end panel in position by fixing the end tab to a side wall or to the underside of the corresponding second end panel, the end tab having itself been folded into the appropriate configuration;

b) folding the second end panel and securing it in position;

c) folding the opposing end flaps and securing in position.

48. A method as claimed in claim 44, in which the end flaps are folded substantially simultaneously.

49. A method as claimed in claim 33, in which an item or items to be stored are inserted into an interior void defined by the assembled side walls prior to the step of forming the end walls.

50. A method as claimed in claim 49, in which both end walls are formed substantially simultaneously.

51. A method as claimed in claim 33, in which a first end wall is formed and an item or items to be stored is/are inserted into an interior void defined by the assembled side walls and the first end wall prior to the second wall being formed.

* * * * *